US006755123B2

(12) United States Patent
Flaum et al.

(10) Patent No.: US 6,755,123 B2
(45) Date of Patent: Jun. 29, 2004

(54) STRAPPING MACHINE WITH MODULAR HEADS

(75) Inventors: Russell M. Flaum, Lincolnshire, IL (US); Timothy B. Pearson, Antioch, IL (US); Ronald W. Gurak, Oakwood Hills, IL (US); Jonathan Lopez, Vernon Hills, IL (US)

(73) Assignee: Illinois Tool Works, Glenview, IL (US)

( * ) Notice: Subject to any disclaimer, the term of this patent is extended or adjusted under 35 U.S.C. 154(b) by 253 days.

(21) Appl. No.: 10/315,365

(22) Filed: Dec. 10, 2002

(65) Prior Publication Data

US 2003/0079618 A1 May 1, 2003

Related U.S. Application Data

(62) Division of application No. 09/966,641, filed on Sep. 28, 2001.

(60) Provisional application No. 60/304,892, filed on Jul. 12, 2001.

(51) Int. Cl.[7] ..... B65B 13/04; B65B 13/24

(52) U.S. Cl. ..... 100/26; 100/29; 100/32; 53/589

(58) Field of Search ..... 100/5, 6, 8, 26, 100/29, 33, 32; 53/589, 590, 591

(56) References Cited

U.S. PATENT DOCUMENTS

| | | | | | |
|---|---|---|---|---|---|
| 3,057,289 | A | * | 10/1962 | Luthi | 100/26 |
| 3,196,779 | A | * | 7/1965 | Embree | 100/4 |
| 4,161,910 | A | * | 7/1979 | Leslie et al. | 100/26 |
| 4,262,587 | A | * | 4/1981 | Russell | 100/4 |
| 4,444,097 | A | * | 4/1984 | Wehr et al. | 100/4 |
| 4,724,659 | A | * | 2/1988 | Mori et al. | 53/589 |
| 5,613,432 | A | | 3/1997 | Hoshino | |
| 5,746,882 | A | * | 5/1998 | Bell et al. | 156/580 |
| 6,415,712 | B1 | * | 7/2002 | Helland et al. | 100/26 |

* cited by examiner

*Primary Examiner*—Allen Ostrager
*Assistant Examiner*—Shelley Self
(74) *Attorney, Agent, or Firm*—Mark W. Croll; Donald J. Breh; Welsh & Katz, Ltd.

(57) ABSTRACT

A strapping machine for positioning a strapping material around an associated load and sealing the strapping material to itself around the load, includes a modular strapping head and a modular feed assembly. The strapping head and feed assembly are readily installed on and removed from the strapping machine without tools. The Strapping machine includes a frame, a chute mounted to the frame and defining a strap path, the feed assembly mounted to the frame by a first aligning and mounting assembly, the strapping head assembly mounted to the frame by a second aligning and mounting assembly independent of the first mounting assembly, and a guide mounted to the frame adjacent the feed assembly. Both the feed assembly and the strapping head are independently removable from the frame.

4 Claims, 9 Drawing Sheets

S
L
W
P
F 12
16
S
10
22
66
20
71
64
14
72
70
68a
62
82
80
84
76
78
74
18
32
S
P

STRAPPING MACHINE WITH MODULAR HEADS

CROSS REFERENCE TO RELATED APPLICATIONS

This application is a divisional application of U.S. patent application Ser. No. 09/966,641, filed Sep. 28, 2001.

This application claims the benefit of Provisional App. No. 60/304,892 file Jul. 12, 2001

BACKGROUND OF THE INVENTION

Strapping machines are in widespread use for securing straps around loads. There are two principle types of strappers. One type is a manually operated hand tool that can be used, for example, around a job site. Another type of strapper is a stationary arrangement in which the strapper is fabricated as part of an overall apparatus. In such a strapper, the strapping head and drive mechanisms are typically mounted within a frame. A chute is likewise mounted to the frame, through which the strapping material is fed.

In a typical, stationary strapper, the strapping head is mounted at about a work surface, and the chute is positioned above the work surface and above the strapping head. Strap material is fed to the strapping head by a set of feed and take-up wheels. The strapping material is fed, by the feed wheels past the strapping head, around the chute and back to the strapping head. The free end of the strapping material is then grasped, such as by a first part of a gripping arrangement. The strap is then retracted by the take-up wheels and tensioned around the load. The tensioned strap is then gripped by a second part of the gripping arrangement. A cutter in the strapping head then cuts the tensioned strap (from the source or supply) and the strapping head forms a seal in the strapping material, sealing the strapping material to itself around the bundled load.

Strapping operations are typically secondary operations in that these operations are used for bundling or securing individual items into a single, large load. The straps themselves are not of commercial concern to the end user; rather, it is the bundled items that are of concern. As such, it is important to be able to strap and move the items quickly and in a cost effective manner.

To this end, improvements have been made to strapping machines. One such improvement includes an auto re-feed arrangement, such as that disclosed in Bell, et al., U.S. Pat. No. 5,640,899, commonly assigned herewith. In such an arrangement, in the event of a misfeed of strapping material, the misfed strap is cut and ejected from the machine. Fresh strapping material is then automatically re-fed by the feed wheels through the strapping head and around the load. It has been found that such an arrangement saves considerable time and labor vis-à-vis removing the misfed or snapped strap and refeeding strap material into the strapper.

One drawback to the known re-feed arrangements is that they require separate feed and take-up wheels. That is, a pair of wheels (generally one driven and one idle) is required to feed the strapping material through the strapping head and the chute. A second, separate set of wheels (again, one driven and one idle) is required to take-up or retract the strap in order to tension the strap around the load. While these automatic re-feed arrangements have been found to save considerable time and labor, the requisite two pairs of wheels introduce additional maintenance concerns as well as timing arrangements with respect to the overall operation of the machine.

It has also been found that typically, these stationary types of strappers are designed and constructed such that the feed and take-up mechanism is located near to the strapping head. Because of the proximity of the feed and take-up arrangement to the strapping head, two sets of feed and take-up wheels are required in order to meet the overall operating requirements, given the physical constraints of the equipment.

Present designs of stationary strappers, which include a closely located feed and take-up mechanism to the strapping head, also include guide paths to, from and between components that are all fixedly mounted to the machine. In the event of maintenance or repair, the machine must be taken out of service for the duration of that work. In addition, skilled technicians are generally required to tend to the machine during the entirety of the maintenance or repair procedure.

Accordingly, there exists a need for a strapping machine that utilizes modular components, specifically for the drive and sealing functions. Desirably, such a modular design permits positioning the feed/take-up mechanism at a location such that only a single set of wheels is required. In such an arrangement, the modular components are readily removed and installed in machines to minimize the "down time" of such machines. Most desirably, such modular components are readily installed and removed, with minimal or no tools. In such a strapper, an auto re-feed arrangement is desirable without the use of separate feed and take-up reels.

BRIEF SUMMARY OF THE INVENTION

A strapping machine for positioning a strapping material around an associated load and sealing the strapping material to itself around the load, includes a modular strapping head assembly and a modular feed assembly. The strapping machine includes a frame, a chute defining a strap path and having an opening therein that is mounted to the frame, the modular feed assembly mounted to the frame and the modular strapping head assembly mounted to the frame. A guide is mounted to the frame between the feed assembly and the strapping head.

The feed assembly is mounted to the frame by a first aligning and mounting assembly. The feed assembly is configured to feed the strapping material therethrough. The modular feed assembly is independently removable from the frame. In a preferred configuration, the feed assembly is mounted to the frame in an configuration such that it is installed in and removed from the frame without the use of tools.

The strapping head is mounted to the frame by a second aligning and mounting assembly independent of the first mounting assembly, the feed assembly and the guide. The strapping head assembly is, like the feed assembly, independently removable from the frame. The strapping head is configured for receipt in the chute opening and to provide a conveyance path for the strapping material from the guide to the chute. The strapping head assembly is further configured to receive a free end of the strapping material and to seal the strapping material to itself. In a preferred configuration, the strapping head assembly is mounted to the frame in a configuration such that it is installed in and removed from the frame without the use of tools.

The guide is mounted to the frame independent of the feed assembly. The guide is configured to receive the strapping material from the feed assembly and to provide a path for the strapping material to the head and toward the chute.

In one embodiment, the first aligning and mounting assembly (the assembly for mounting the feed assembly) includes first and second cooperating, aligning members for aligning the feed assembly on the frame and a securing member for securing the feed assembly to the frame. Likewise, the second aligning and mounting assembly can include first and second cooperating, aligning members for aligning the strapping head assembly to the frame and a securing member for securing the strapping head assembly to the frame.

In one configuration, the first aligning member is formed as a base portion having a receiving member and the second aligning member is formed as a nesting member configured for receipt in the receiving member. The receiving member can be formed having at least one slot or notch and the nesting member has a shape complementary to the at least one notch.

In a current configuration, the receiving member is formed having a pair of rounded slots or notches and the nesting member is formed as a cylindrical element, such as a bar, configured for receipt in each of the pair of notches. For the feed assembly, the receiving member can be disposed on the feed assembly and the nesting member can be formed on the frame. For the strapping head, the receiving member can be disposed on the frame, and the nesting member can be formed on the strapping head assembly.

The securing member can include a clamping element. Preferably, the clamping element is a hand-tightened element. The hand-tightened element can be a threaded stud threadedly engageable with the feed assembly, The frame can be formed having a notch for receiving the stud. To facilitate installation, the notch can have an enlarged entrance region.

In such an arrangement, the location of the feed assembly vis-à-vis the strapping head permits use of a feed assembly having one pair of wheels for feeding the strapping material for retracting the strapping material.

In an alternate embodiment, in mounting the strapping head, the first aligning member can be configured as a rail and the second aligning member as a rail pin configured for traversing along the rail. Preferably, this embodiment includes a pair of rails and plurality of rail pins for traversing along the rails. The rail pins are can be mounted to the strapping head assembly and the pair of rails are preferably mounted to the frame on opposing sides of the chute, at about the chute opening. In a current embodiment, the rails are formed having upper and lower flanges for maintaining the rail pins therebetween.

The securing member can be formed as a latch assembly. In one embodiment, the latch assembly is mounted to the rail and includes a detent for engaging at least one of the rail pins to maintain the strapping head assembly in place between and along the rails. The latch assembly can include a release portion for engaging and disengaging the detent with the rail pin. In a preferred embodiment, a biasing element, such as a coil spring, biases the detent to engage the rail pin. Alternately, the latch assembly can be pivotally mounted to the strapping head for engaging a detent on one of the rails.

The present invention further contemplates a modular strapping head assembly for use with the strapping machine. The modular strapping head assembly includes a body, a strap receiving portion, a strapping material sealing portion, and an aligning and mounting portion. The aligning and mounting portion is configured for independent, tool-less installation and removal from the strapping machine. The aligning and mounting portion is adapted for positioning the strapping head at the chute opening and maintaining the strapping head at the chute opening, and further provides a conveyance path for the strapping material from into the chute.

In one configuration, the aligning and mounting portion includes a plurality of rail pins cooperable with associated rails positioned on the strapping machine. At least one of the rail pins is further configured for cooperation with an associated retaining assembly positioned on the strapping machine to maintain the strapping head at the chute opening. Alternately, the retaining assembly is mounted to the strapping head assembly and cooperates with one of the rails to maintain the strapping head at the chute opening.

Alternately, the aligning and mounting portion includes one of a cooperative nesting and receiving member, and a clamping member. The nesting member is configured for receipt in the strapping machine to position the strapping head assembly in place. The clamping member engages the strapping machine to retain the strapping head assembly in place.

The present invention further contemplates a modular feed assembly for use with the strapping machine. The feed assembly includes a body, a drive, a pair of wheels, one of the pair of wheel being operably connected to the drive, a strap guide disposed over at least a portion of each of the pair of wheels, and an aligning and mounting portion.

The aligning and mounting portion is configured for independent, tool-less installation and removal of the modular feed assembly from the strapping machine. The aligning and mounting portion is adapted for positioning the feed assembly at an associated second strap guide, which strap guide provides a conveyance path for the strapping material from the modular feed assembly to the strapping head.

In a preferred embodiment, the aligning and mounting portion includes one of a cooperative nesting and receiving member, and a clamping member. Preferably, the aligning and mounting portion includes the nesting member, which member is configured for receipt in the strapping machine (having the receiving member) to position the strapping head assembly in place. The clamping member engages the strapping machine to retain the strapping head assembly in place.

The strapping machine can further include quick-connect electrical connectors to further facilitate modularity, easing installation and removal of the modular components. More preferably, the frame and strapping head include mating portions of such a connector to facilitate removal and installation of the strapping head.

In a current embodiment, as set forth above, because of the positioning of the feed assembly vis-à-vis the strapping head, the feed assembly need include only one pair of wheels for feeding and retracting the strapping material.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figures 1, 2:
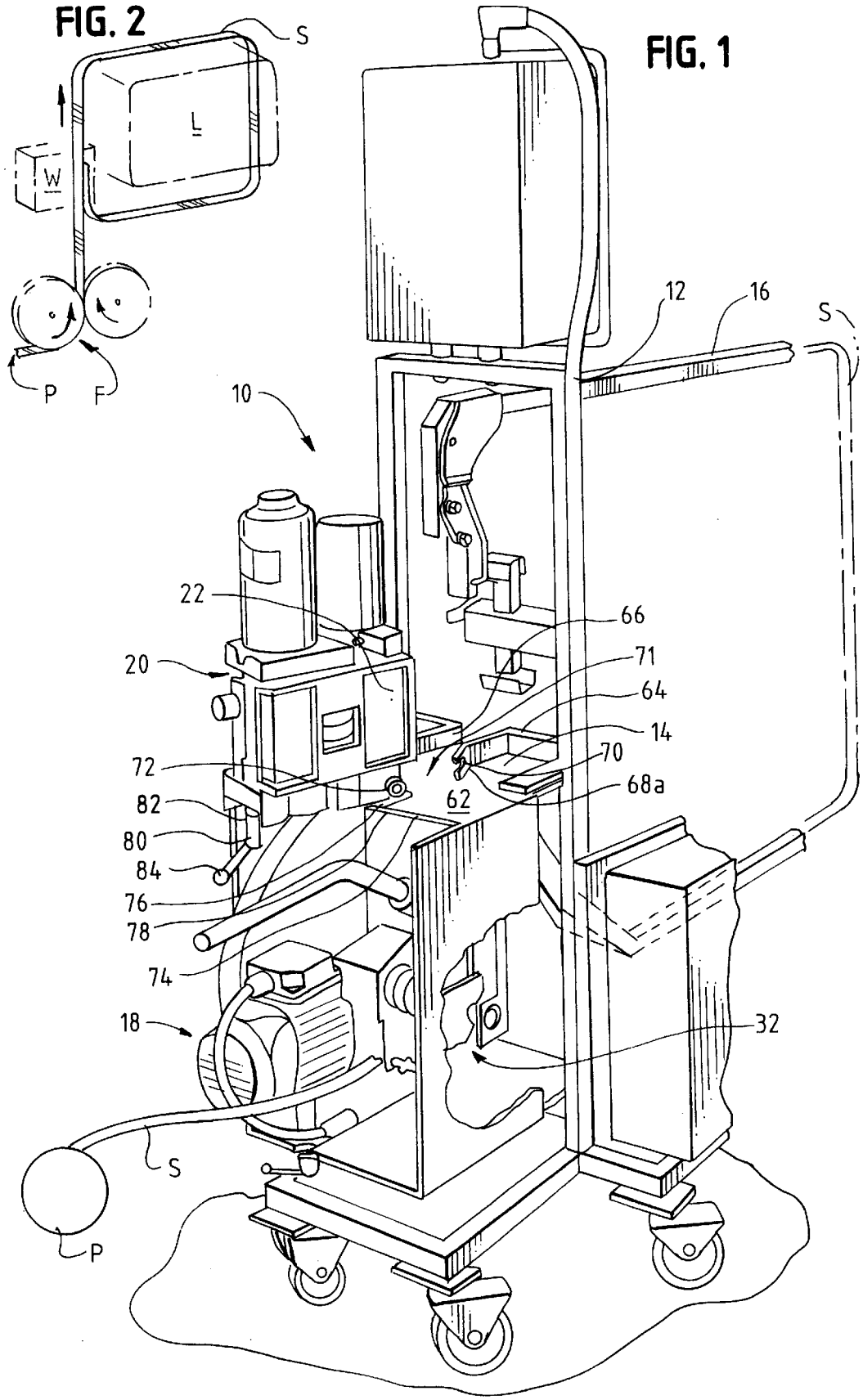
FIG. 1 is perspective view of one embodiment of a modular strapping machine embodying the principles of the present invention.
FIG. 2 is a schematic illustration of the strapping machine function, illustrating the strap being fed around a load.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular, to FIG. 1, there is shown one embodiment of a strapper 10 in accordance with the principles of the present invention. The strapper 10 includes a frame 12 having a work surface or top mounted 14 thereto. The frame 12 defines a chute or strap path 16 about which the strap S is conveyed during a strapping operation. A strap supply P provides the strap material S for the strapper 10.

Strap S is fed from the supply P into the strapper 10 by a feed arrangement 18. The strap S is conveyed by the feed arrangement 18, through a strapping head 20 and into the chute 16. The strap material S traverses through the chute 16 back around to the strapping head 20. The free end (that is the first fed end of the strap S) is, upon return to the strapping head 20, gripped by a gripper 22 in the strapping head 20. The feed mechanism 18 then reverses to provide tension in the strap S. When a desired tension is achieved, the strap S is again gripped by the gripper 22, and is then cut to separate the strap S from the source P. The strap S is then welded or otherwise sealed onto itself by methods known in the art. The load L is then removed from inside the chute 16 region or strap path and a new load is positioned therein for strapping.

Figure 3:
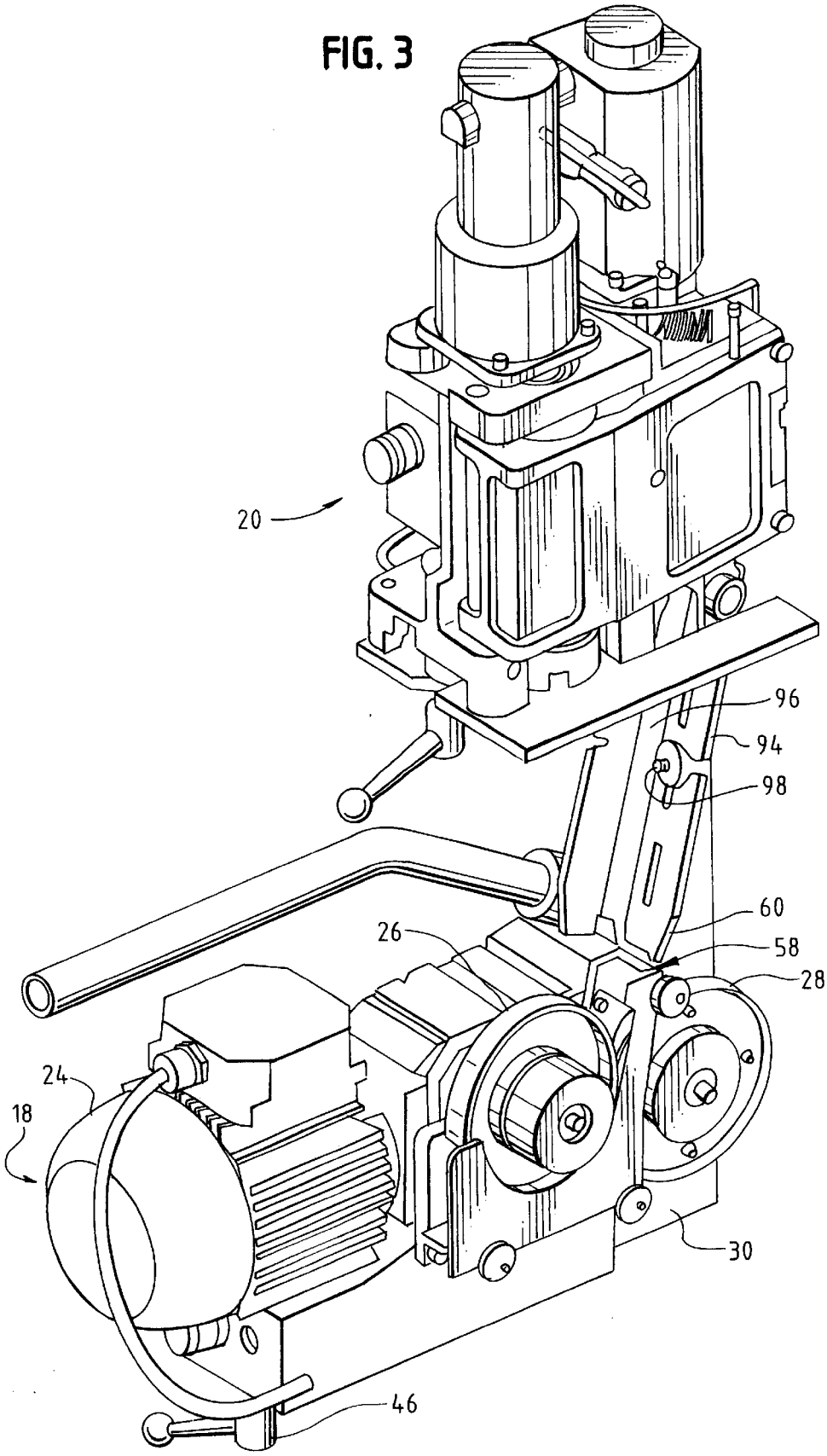
FIG. 3 is a partial perspective view of the modular strapping machine feed assembly and strapping head removed from the frame for clarity of illustration.

Unlike known strappers, the present strapper 10 includes a modular arrangement in which the feed assembly 18 and strapping head assembly 20 are removably mounted to the frame 12. Preferably, as in the illustrated arrangements, the feed assembly 18 and strapping head 20 are removable from the frame 12 without the use of tools. The feed arrangement 18, which includes generally a motor 24, and a pair of feed wheels 26, 28, is mounted to a base 30 that is in turn mounted to the frame 12. Referring to FIG. 3, there is shown an exemplary feed assembly 18 illustrating the position of the motor 24, and a driven wheel 26 and an idler wheel 28. Those skilled in the art will recognize that the idler wheel 28 is mounted for free rotation with the driven wheel 26 when the strap material S is between the wheels 26, 28, and the motor 24 is actuated.

Figure 4:
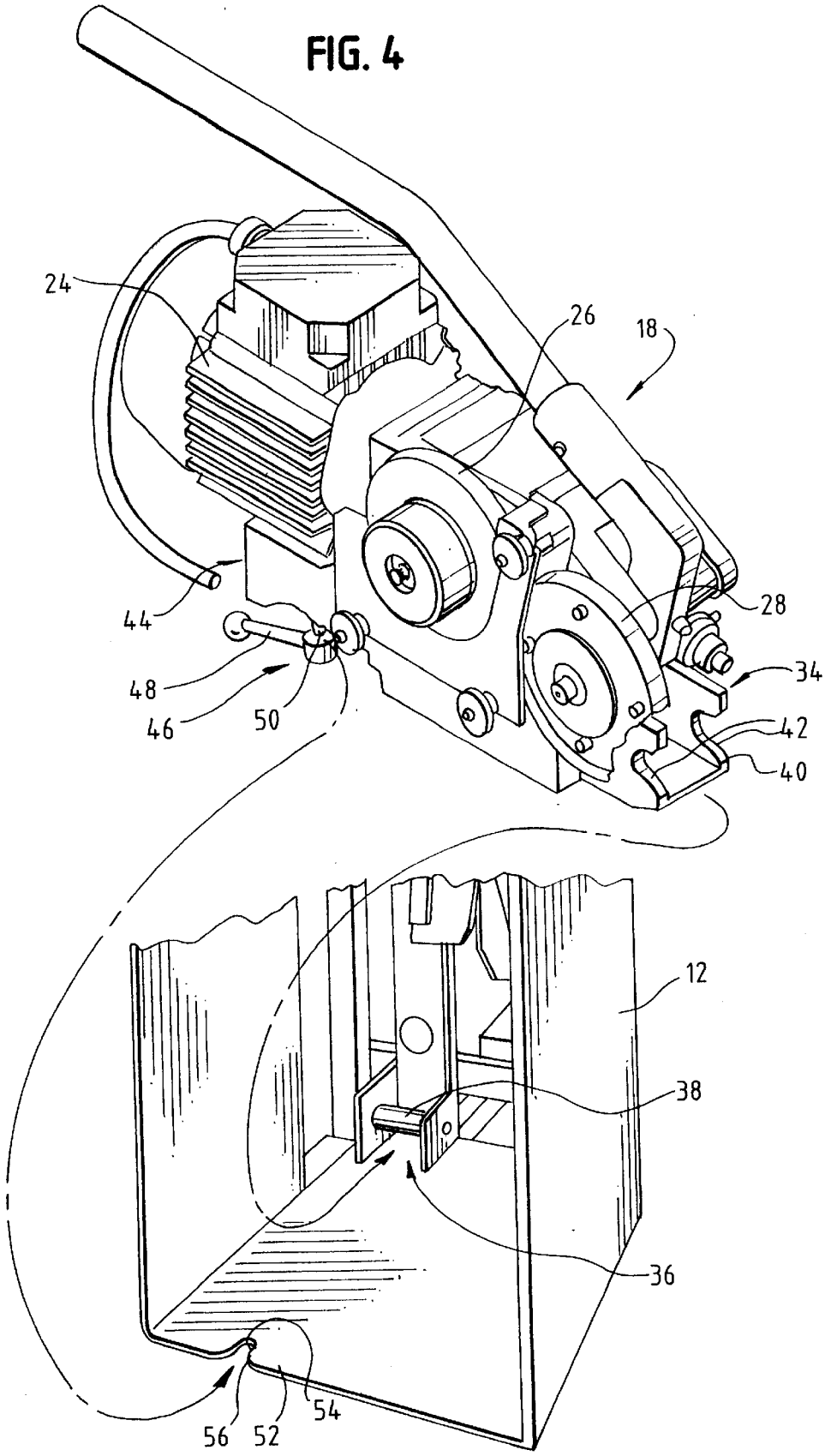
FIG. 4 is a partial perspective view of the feed assembly and the frame portion in which it is mounted.

To assure that the feed assembly 18 is properly mounted within the frame 12, the feed assembly 18 and frame 12 include portions of a cooperating aligning and mounting assembly, indicated generally at 32, in which first and second aligning members 34, 36, respectively, align the feed assembly 18 on the frame 12. In one such arrangement, as shown in FIGS. 1 and 4, the frame 12 includes a nesting member 38 configured as a transverse extending element. The feed assembly 18 includes a complementary, cooperating receiving member 40 that aligns with the nesting member 38. In a current embodiment, the nesting member 38 is formed as a bar and the feed assembly 18 receiving member 40 is formed as a generally channel shaped aligning head having a pair of slots or rounded notches 42 formed therein that are complementary to the bar 38. The feed assembly 18 is positioned in the frame 12 such that the bar 38 is fitted into the receiving member notches 42. This aligns the feed assembly 18 in the frame 12.

At a rear end 44 of the feed assembly 18, the aligning and mounting assembly 32 includes a securing member or clamping element 46. In the illustrated embodiment, the clamping element 46 is formed as a handle 48 that is mounted to a threaded stud 50. The frame 12 includes a base portion 52 having a notch 54 formed therein. The notch 54 can have an enlarged entrance formed, for example, by a V-shaped opening 56 to readily permit aligning the stud 50 in the notch 54. As the feed assembly 18 is positioned on and in the frame 12, the forward aligning notches 42 are positioned immediately forward of the nesting member or bar 38 and the stud 50 is positioned in the open end of the V-opening 56. The feed assembly 18 is then urged forward until the notches 42 are positioned on the bar 38 and the stud 50 is positioned in the base notch 54. The handle 48 is then rotated to tighten the clamp 36 until the feed assembly 18 is secured in the frame 12. In this manner, a discharge region 58 of the feed assembly 18 (as illustrated in FIG. 3) is properly aligned with the strap path or guide 60 for transport of the strapping material S to the strapping head 20.

The strapping head 20 is mounted to the frame 12 in a similar manner. The strapping head 20 and frame 12 include portions of an aligning and mounting assembly, indicated generally at 71. The frame 12 includes an upper base or shelf 62 having a transverse, forward lip 64. The lip 64 has an opening or receiving member 66 therein for receiving the strapping head 20. The receiving member 66 is defined by a pair of walls 68 having aligning slots or notches 70 formed therein.

The strapping head 20 includes an aligning element or nesting member 72 that, when the head 20 is moved forwardly in the frame 12, resides in the aligning notches 70. In the illustrated embodiment, the nesting member 72 is formed as a transverse tubular or like member, and the aligning notches 70 are formed complementary to the tubular member 72 shape.

A rear end 74 of the base 62 includes a notched opening 76 having a V-shaped entrance 78. The strapping head 20 includes a securing member formed as a clamping element 80. The clamping element 80 includes a threaded stud 82 and a handle 84 for rotating the stud 82. As with the feed assembly 18, when the strapping head assembly 20 is urged forward, the nesting member 72 is urged into the notches 70 as the stud 82 is urged into the clamping notch 76. Once the strapping head 20 is positioned in the frame 12, the handle 84 is rotated to clamp the strapping head 20 in place.

An alternate embodiment of the modular strapper design 110 is illustrated in FIGS. 5–10. In this embodiment, the strapping head assembly 120 and the feed assembly 118 are both mounted to the frame 112 along a side of the chute 116, rather than below the chute. The feed assembly 118 is mounted to the frame 112 in a similar manner to the embodiment 10 of FIGS. 1–4. That is, the feed assembly 118 and frame 112 include portions of a cooperating aligning and mounting assembly 132. In this illustrated arrangement, the frame 112 includes a support base having a receiving member 140 formed as a pair of slots or rounded notches 142. The notches 142 can have an open entrance formed as a V-shaped opening 144 to readily permit aligning the feed assembly 118 in the frame 112. The feed assembly 118 includes an aligning or nesting member 138 at a lower portion thereof. In the exemplary embodiment, the nesting member 138 is formed as a tubular or like element that cooperates with, i.e., fits into the base notches 142. This aligns the feed assembly 118 in the frame 112.

At an upper end 136 of the feed assembly 118, a securing or clamping element 146 includes a threaded stud 150 having a handle 148 at an end thereof. The stud 150 inserts through the frame 112 and threadedly engages the feed assembly 118. This locks the feed assembly 118 in place on the frame 112. Other locking arrangements will be readily appreciated by those skilled in the art and are within the scope and spirit of the present invention. As will also be appreciated by those skilled in the art, the present arrangement permits readily installing and removing the feed assembly 118 from the strapper frame 112 with minimal, if any tools required.

The strapping head 120 is mounted to the frame 112 by an aligning and mounting assembly 171 that is configured as a guide or rail-type arrangement. In this arrangement, first aligning members are formed as opposing rails 172 that are mounted to the frame 112 along a vertical side of the chute 116. In a present configuration, the rails 172 are mounted transverse to the chute 116; that is, directed in toward the chute 116. The rails 172 include upper and lower flanges 174, 176, respectively that define a rail slot 178. An opening, indicated generally at 180, is defined in the chute 116, between the rails 172, in which the strapping head 120 resides.

The strapping head 120 includes a second aligning member formed as guide pins 182 mounted to a support plate 183. The guide pins 182 are configured for receipt in the rail slot 178, that is, between the upper and lower flanges 174, 176. In this manner, the strapping head 120 is positioned between the rails 172, with the guide pins 182 resting on the lower flanges 176. The head 120 is slid along the rails 172 until an anvil portion 184 of the head 120 resides aligned with strap path (i.e., the chute 116) at the opening 180. The strapping head anvil 184 is that portion through which the strap material S traverses and in which the strap S resides when it is welded or otherwise sealed onto itself.

When the feed assembly 118 and strapping head 120 are mounted to the frame 112 by their respective aligning and mounting assemblies 132, 171, the strap path from the feed assembly 118 up to the strapping head 120 is likewise, properly aligned for operation of the strapper 110.

Figure 5:
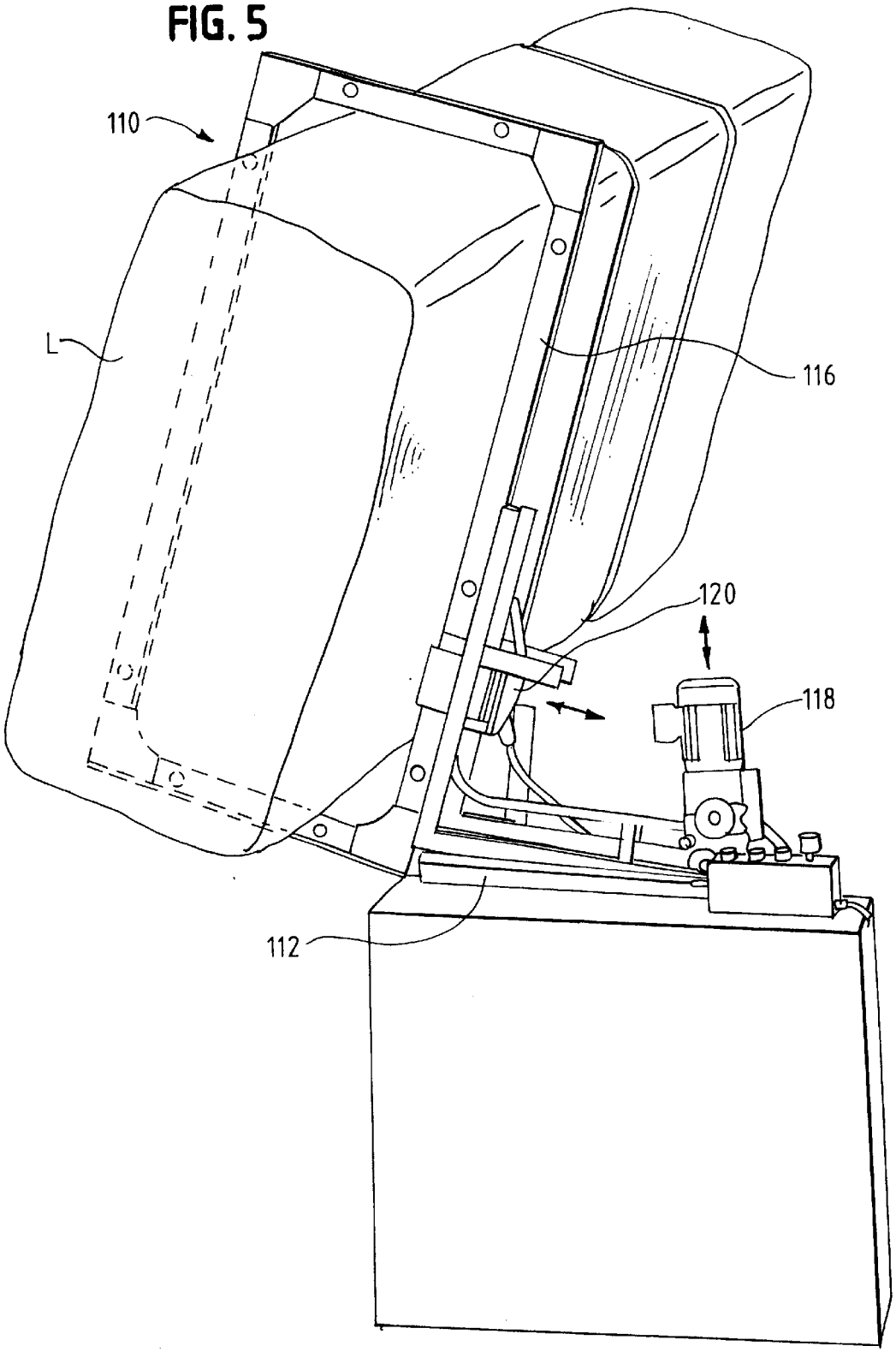
FIG. 5 is a perspective view of an alternate embodiment of the modular strapping machine.
Figure 6:
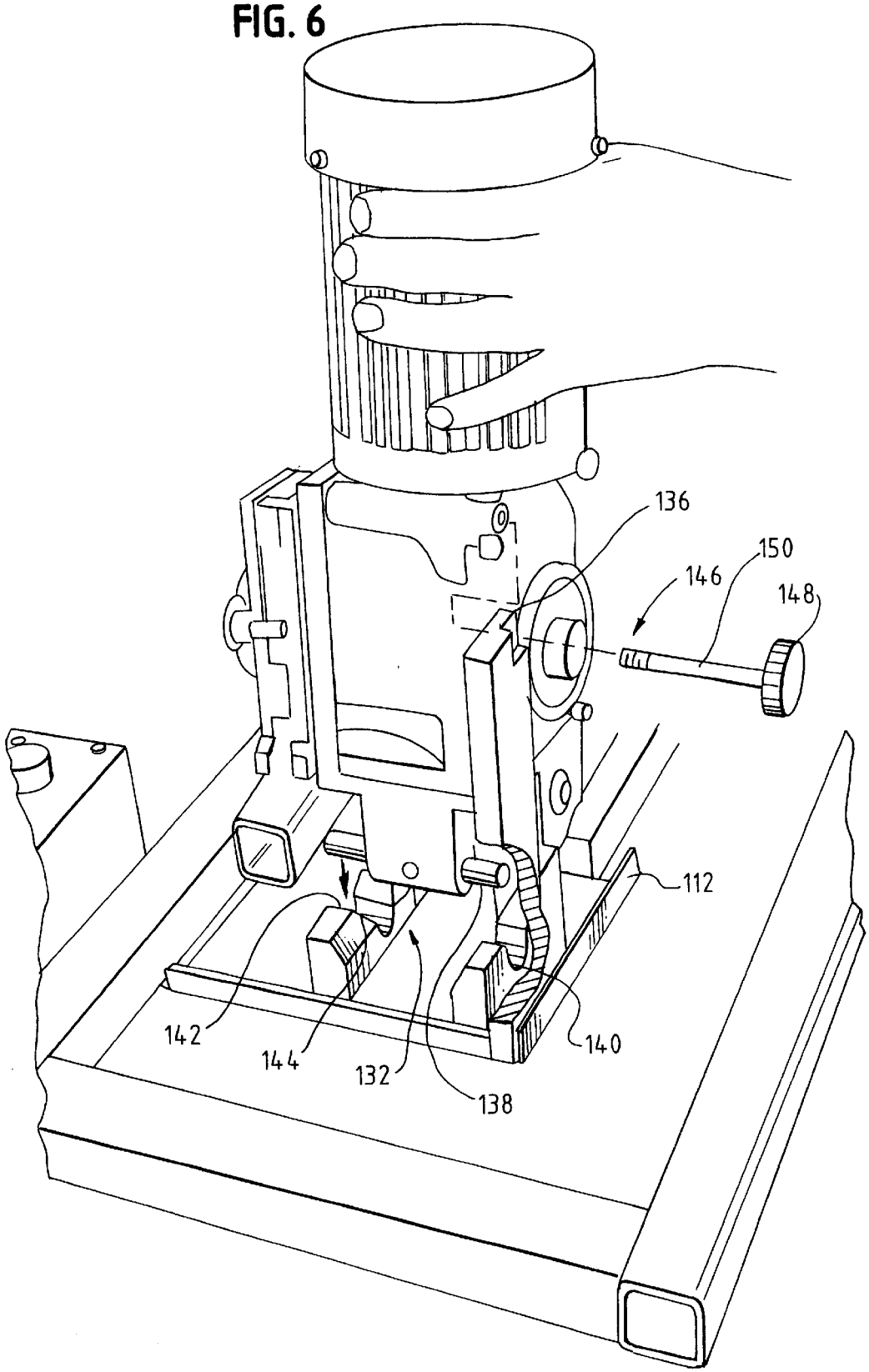
FIG. 6 is a partial view of the feed assembly of the strapper of FIG. 5, the assembly being shown as it is being placed into the frame.
Figures 7, 8:
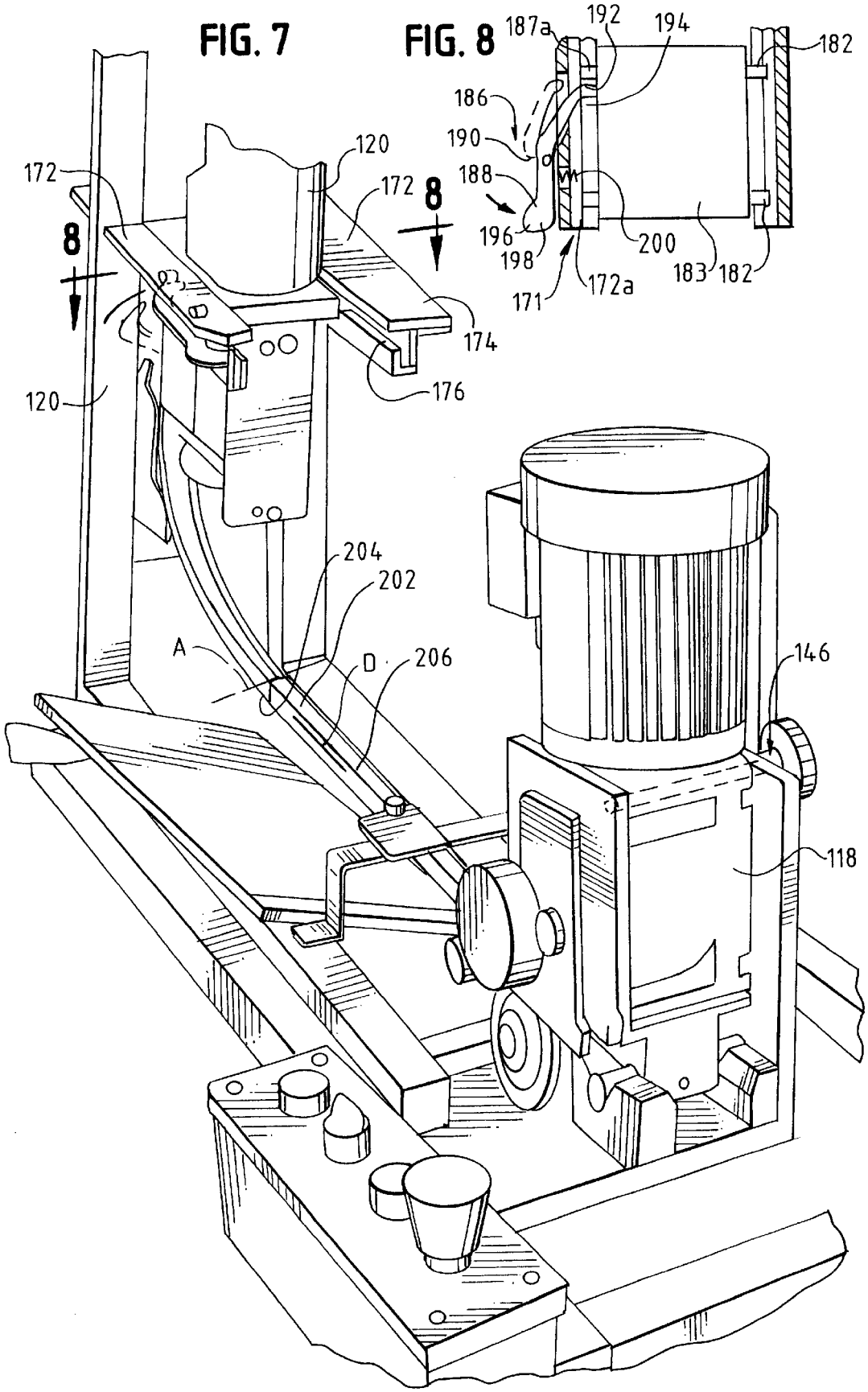
FIG. 7 is a rear perspective view of the strapper of FIG. 5 showing the feed assembly and the strapping head.
FIG. 8 is a partial cross-sectional view taken along line 8—8 of FIG. 7 and showing the latch assembly for retaining the strapping head in place in the frame.
Figure 9:
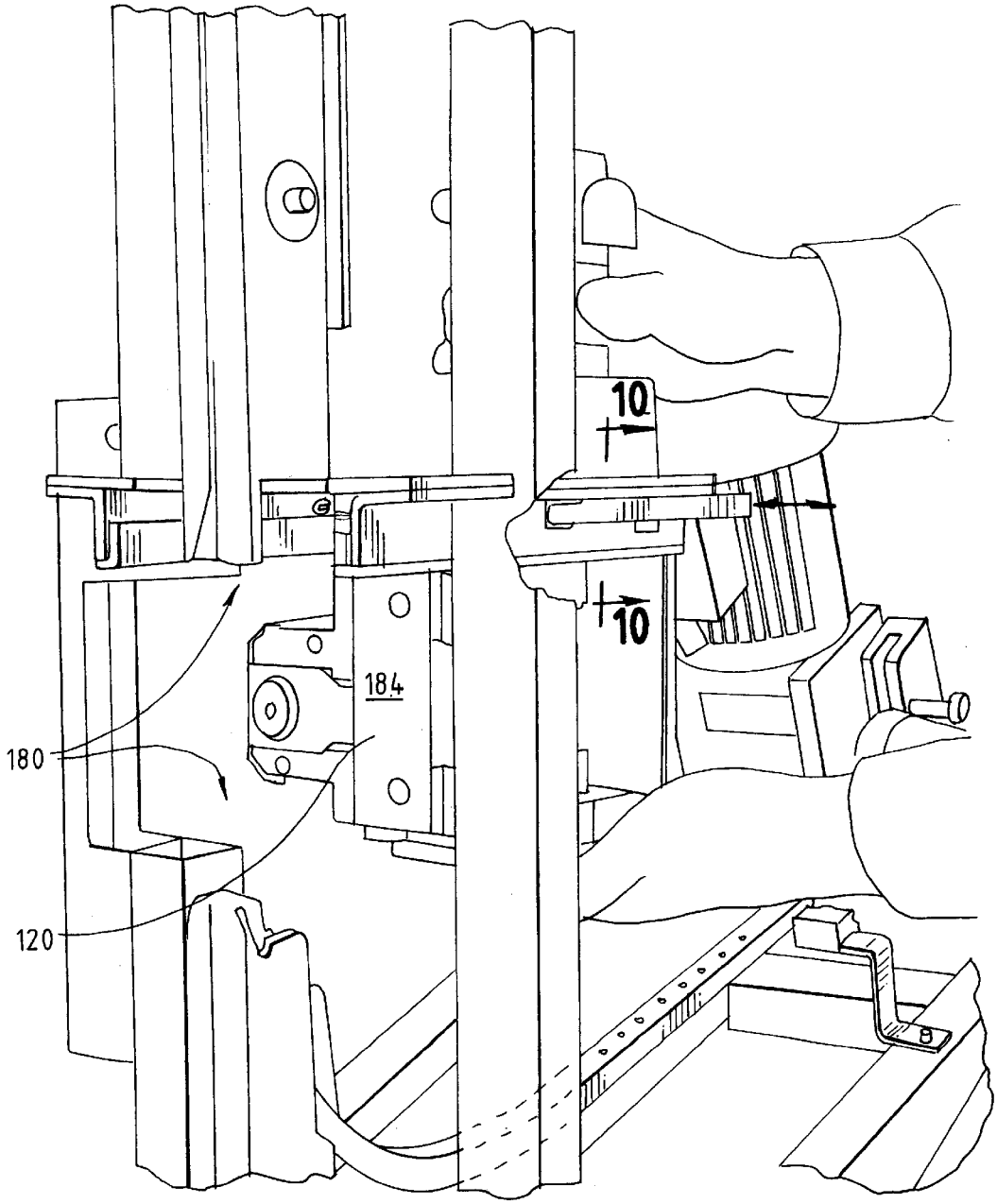
FIG. 9 is a partial perspective view showing the removal of the strapping head from the frame.
Figure 10:
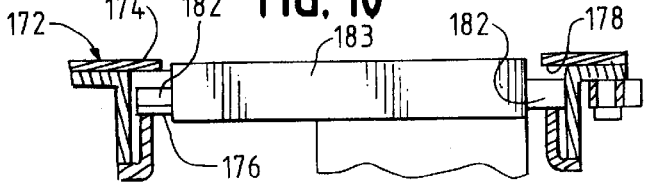
FIG. 10 is a cross-sectional view taken along line 10—10 of FIG. 9 showing the rails on which the strapping head is retained.

In this embodiment 110, the chute 116 can be positioned or leaned at various angles (as seen in FIG. 5) between the horizontal and about 15° from the horizontal. Referring now to FIGS. 8–10, to this end, the rails 172, which are mounted generally transverse to the chute 116, include a securing element formed as a latch assembly 186 (as part of the aligning and mounting assembly 171) to lock the strapping head 120 in place along the rails 172. This further maintains the head 120 positioned so that the anvil 184 opening (not shown) lies along and aligned with the strap path at the chute 116.

The latch assembly 186 includes a latch lever 188 mounted to one of the rails 172*a*. The lever 188 is mounted to the rail 172*a* by a pivot pin 190 to permit pivotal movement of the lever 188. The lever 188 includes a detent 192 that protrudes through an opening 194 in the rail 172*a*. The detent 192, when the lever 188 is in the latched position, engages one of the guide pins 182*a* to interfere with or prevent movement of the head 120 from its latched position along the rails 172. The lever 188 is actuated by a release tab 196 positioned on an end 198 of the lever 188 opposite to that of the detent 192.

A biasing element 200, such as the exemplary coil spring, is positioned between the lever 188 and the flange 172*a*, intermediate the pivot pin 190 and the release tab 196. The spring 200 biases the lever 188 to the latched position, that is with the detent 192 extending or protruding through the rail opening 194. Depressing the release tab 196 (urging it toward the rail 172*a*) moves the detent 192 from the rail opening 194, thus disengaging the detent 192 from the guide pin 182*a*. This permits removing (e.g., sliding) the strapping head 120 from the frame 112. Conversely, releasing the release tab 196 allows the latch 186 to move back into the latched position, locking the head 120 in place.

Figure 11:
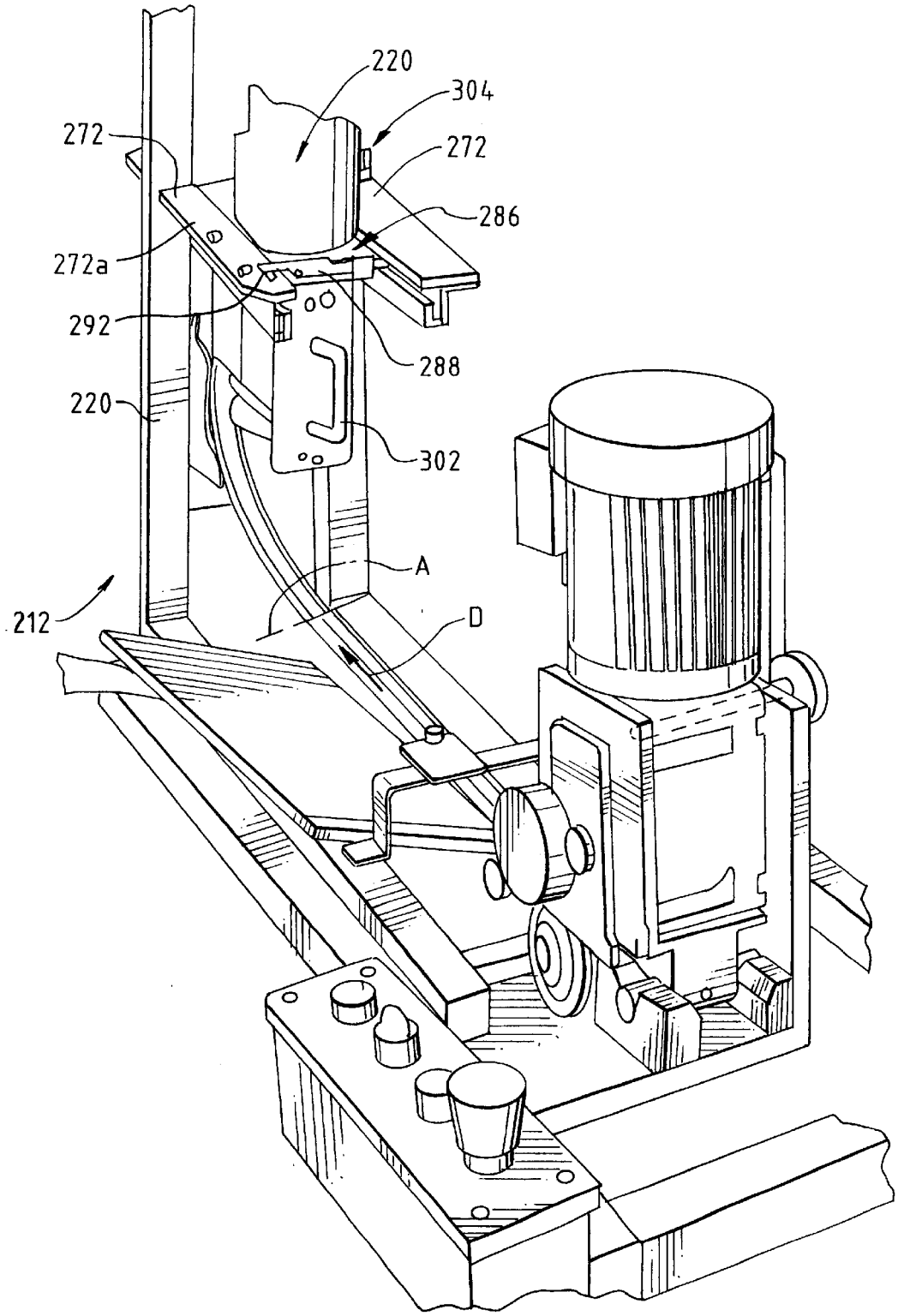
FIG. 11 is a view similar to FIG. 7 illustrating an alternate latch assembly and a quick-connect electrical assembly for the strapping head.
Figure 12:
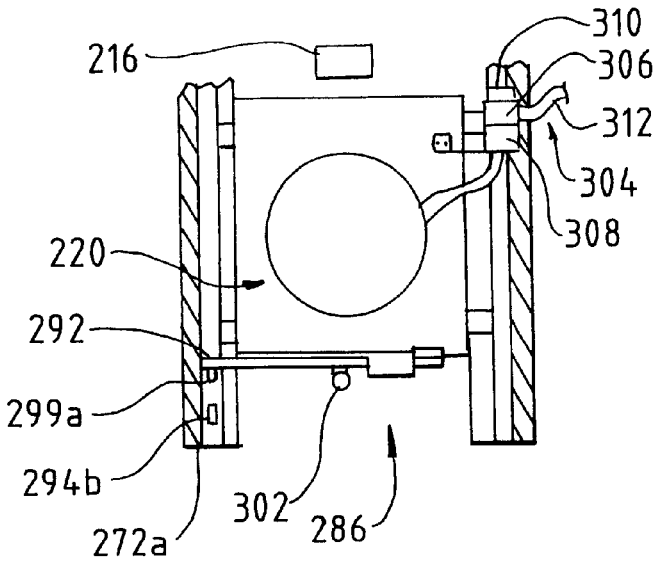
FIG. 12 is a partial top view illustrating the alternate latch assembly and quick connect assembly.
Figure 13:
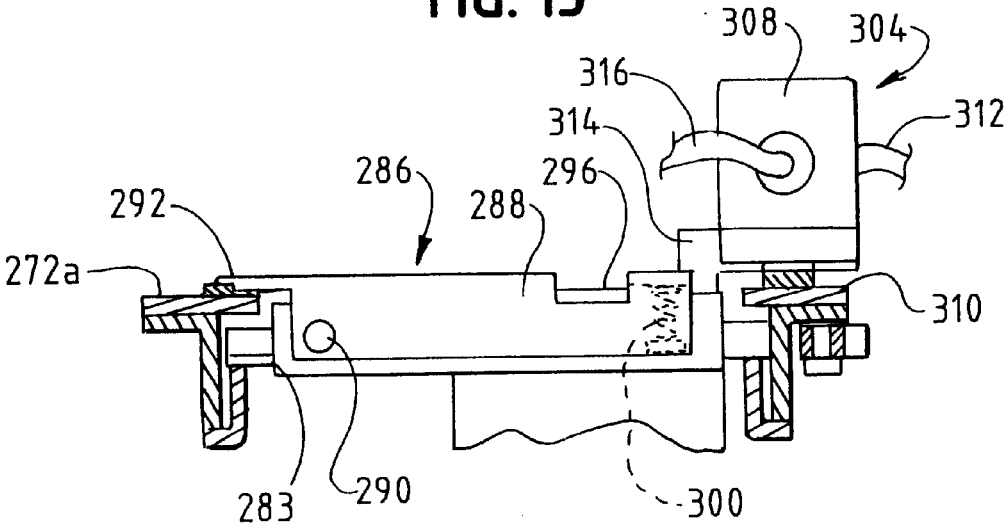
FIG. 13 is a cross-sectional view taken along line 13—13 of FIG. 11.

An alternate latch assembly 286 is illustrated in FIGS. 11–13. In this embodiment, a latch lever 288 is mounted to the support plate 283, by a pivot pin 290 to permit pivotal movement of the lever 288. The lever includes a finger portion 292 that extends over one of the rails 272*a*. At least one, and preferably, a pair of detents are 294*a,b* extend upwardly from the rail 272*a* to cooperate with the finger 292. When the head 220 is fully in place between the rails 172, and the lever 288 (and finger 292) are in the downward or engaged position, the finger 292 engages detent 294*a* to maintain the head 220 fixed in the frame 212.

A biasing element 300 maintains the lever 288 in the engaged position. A release tab 296, positioned opposite the finger 292, provides for an operator to urge the lever 288 from the engaged position to the disengaged position to permit moving the head 220. The second detent 294*b* is position along the rail 272*a*, spaced from detent 294*a*. This detent permits moving the head 220 from the "in place" position (i.e., operating position), to a position away from the chute 216, while maintaining the head 220 along the rails 272. Those skilled in the art will appreciate that this permits inspection of or maintenance on the head 220 while maintaining the head 220 supported by the rails 272.

Additionally, a handle 302 can be positioned on the head 220 to facilitate handling, installation and removal.

As is best seen in FIGS. 12 and 13, the strapping head 220 can be configured with a "quick-connect" or modular connection, shown generally at 304, for all of the required electrical components. In such an arrangement, a male or female multi-connector 306 can be mounted to the frame 212 by a bracket 310. The connector portion 306 can carry all of the fixed or frame side connections 312 required. A mating connector 308 can be mounted to the strapping head 220 by a bracket 314. The connector portion 308 can carry all of the strapping head side connections 316, such as power, control signals and the like. Thus, when the head 220 is slid along the rails 272 in to place, the connectors 306, 308 likewise mate to establish all of the necessary electrical connections. This provides further modularity of the strapping machine 210 and enhances the ability to replace modules quickly and efficiently. Although only shown in the embodiment of FIGS. 11–13, those skilled in the art will appreciate that this "quick-connect" electrical arrangement 304 can be used in connection with the other disclosed embodiments as well. Those skilled in the art will also appreciate and understand the various configurations by which the quick-connect arrangement can be carried out, which other configurations are within the scope and spirit of the present invention.

The present modular strapper 10, 110, 210 has a number of advantages over known strappers. First, the modular, tool-less arrangement permits readily changing out either a strapping head 20, 120 or a feed assembly 18, 118. As such, as maintenance or repair is required on either the strapping head 20, 120 or the feed assembly 18, 118, that portion of the strapper 10, 110 can be removed and a spare inserted in its place. In this manner, the operational "down-time" of the machine is minimized. That is, the strapping head 20, 120 or feed assembly 18, 118 can be removed and a spare installed in its place in perhaps less than a minute. That portion of the strapper 10, 110 requiring maintenance or repair (e.g., the feed assembly 18, 118, or strapping head 20, 120) can then be removed and taken to, for example, a maintenance shop where the necessary work can be carried out, away from the strapping machine 10, 110 and other operations.

Another advantage provided by the present strapper 10, 110 is that it establishes a distance between the feed assembly 18, 118 and the strapping head 20, 120. Those skilled in the art will recognized that, at times, straps become jammed in or are misfed into the strapper 10, 110. When this occurs, it is most desirable to have a strapper 10, 110 having an auto re-feed arrangement. In such an arrangement, the misfed strap is automatically ejected from the strapper 10, 110 and the strap feed is automatically restarted to place the strapper 10, 110 back into operation. Thus, operator time and attention is minimized by automatically ejecting the misfed strap and automatically refeeding from the strap S supply P. An exemplary auto refeed arrangement is illustrated in the aforementioned Bell, et al., U.S. Pat. No. 5,640,899.

One drawback to known auto refeed arrangements is that there must be a sufficient distance between the feed wheels and the strapping head to prevent the strap material from being ejected beyond the feed wheels (by the take-up or tension wheels). This is of particular concern in that the machines operate a relatively high speeds and the detecting instruments and control system have certain reaction time constraints. That is, because the strap is conveyed so quickly through the machine, after a misfeed is detected, the strap can be ejected from the machine by the take-up wheels beyond the feed wheels, thus defeating the auto-refeed function. In other words, if there is insufficient distance between the strapping head (which is the location of the misfeed detector) and the feed wheels, the take-up wheels will eject the strap beyond the feed wheels. As such, there will not be fresh strap stock to be fed through the feed wheels to the strapping head.

Referring to FIG. 1, the present arrangement provides the necessary distance between the strap misfeed detector (as exemplified by the detector 88) and the feed wheels 26, 28. As such, a single set of wheels (i.e., a single pair of wheels 26, 28) can be used for both the feed and the retraction functions. In this manner, when a misfeed is detected, the feed wheels 26, 28 reverse to pull the strap S from about the strapping head 20. When the jammed or misfed strap is cleared, there is sufficient distance between the detector 88 and the feed wheels 26, 28 for the feed wheels 26, 28 to be stopped (from the reverse direction) and returned to the forward feeding direction.

Referring now to FIGS. 7 and 9, the strapper 110 includes an easy access guide 202 that extends from the feed assembly 118 to the strapping head 120. In that this portion of the feed path extends between the two modular components, it is fixedly mounted to the frame 112, independent of the feed assembly 118 and the strapping head assembly 120. In this manner, the guide 202 itself is readily accessible to perform maintenance or, for example, to dislodge debris or jammed strap material. In the embodiment of FIGS. 5–10, the guide 202 includes a fixed lower channel 204, through which the strap S traverses, and a cover portion 206. The cover 206 is hinged, and opens along an axis A transverse to the longitudinal direction D of the strap path and guide 202. Thus, opening the cover 206 provides ready access to essentially the entire length of the channel 204 between the feed assembly 118 and the strapping head 120.

In the embodiment of FIGS. 1–4, the guide 60 includes a fixed portion 94 and a cover portion 96 that is secured in place on the fixed portion 94 by, for example, a mechanical fastener 98, such as the illustrated bolting arrangement. Other configurations for securing the covers in place on the fixed or channel portions 94, 202 will be recognized and appreciated by those skilled in the art, and are within the scope of the present invention.

As will also be appreciated by those skilled in the art, because the chute 116 portion of the embodiment of FIG. 5 "tilts" to various angles, it provides for flexibility with respect to the orientation of the load to be handled, and permits use of the strapper 110 in areas or locations that may not otherwise be able to accommodate the device.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A modular feed assembly for use with a strapping machine of the type including an associated strapping head and an associated chute for positioning, tensioning and sealing a strapping material around an associated load, the feed assembly configured to feed strapping material from an associated source to the associated strapping head and to retract strapping material therefrom to tension the strapping material around the load, the feed assembly comprising:

a body;

a drive;

a pair of wheels, one of the pair of wheel being operably connected to the drive;

a strap guide disposed over at least a portion of each of the pair of wheels; and an aligning and mounting portion, the aligning and mounting portion configured for independent, tool-less installation and removal of the modular feed assembly from the strapping machine, the aligning and mounting portion adapted for positioning the feed assembly at an associated second strap guide providing a conveyance path for the strapping material from the modular feed assembly to the strapping head, wherein the aligning and mounting portion includes one of a cooperative nesting and receiving member, and a clamping member.

2. The modular feed assembly in accordance with claim 1 wherein the aligning and mounting portion includes a nesting member configured for receipt in the strapping machine to position the strapping head assembly in place and wherein the clamping member engages the strapping machine to retain the strapping head assembly in place.

3. The modular feed assembly in accordance with claim 1 wherein the modular feed assembly includes only one pair of wheels for feeding and retracting the strapping material.

4. A modular feed assembly for use with a strapping machine of the type including an associated strapping head and an associated chute for positioning, tensioning and sealing a strapping material around an associated load, the feed assembly configured to feed strapping material from an associated source to the associated strapping head and to retract strapping material therefrom to tension the strapping material around the load, the feed assembly comprising:

a body;

a drive;

only one pair of wheels operably connected to the drive for feeding and retracting the strapping material;

a strap guide disposed over at least a portion of each of the pair of wheels; and an aligning and mounting portion, the aligning and mounting portion configured for independent, tool-less installation and removal of the modular feed assembly from the strapping machine, the aligning and mounting portion adapted for positioning the feed assembly at an associated second strap guide providing a conveyance path for the strapping material from the modular feed assembly to the strapping head.

* * * * *